US011609017B2

(12) United States Patent
Gonia et al.

(10) Patent No.: US 11,609,017 B2
(45) Date of Patent: Mar. 21, 2023

(54) HVAC CONTROLLER WITH A ZONE COMMISSIONING MODE

(71) Applicant: Ademco Inc., Golden Valley, MN (US)

(72) Inventors: Patrick Gonia, Maplewood, MN (US); David J. Emmons, Coon Rapids, MN (US)

(73) Assignee: Ademco Inc., Golden Valley, MN (US)

( * ) Notice: Subject to any disclaimer, the term of this patent is extended or adjusted under 35 U.S.C. 154(b) by 16 days.

(21) Appl. No.: 17/465,573

(22) Filed: Sep. 2, 2021

(65) Prior Publication Data

US 2021/0396416 A1 Dec. 23, 2021

Related U.S. Application Data

(63) Continuation of application No. 16/208,471, filed on Dec. 3, 2018, now Pat. No. 11,112,139.

(51) Int. Cl.
*F24F 11/57* (2018.01)
*F24F 11/54* (2018.01)
(Continued)

(52) U.S. Cl.
CPC ..... *F24F 11/57* (2018.01); *F24F 3/0527* (2013.01); *F24F 11/54* (2018.01); *F24F 11/58* (2018.01);
(Continued)

(58) Field of Classification Search
CPC .. F24F 11/57; F24F 11/54; F24F 11/58; F24F 11/30; F24F 11/52; F24F 11/63; F24F 3/0527; F24F 2110/10; F24F 2120/20
See application file for complete search history.

(56) References Cited

U.S. PATENT DOCUMENTS 2,844,086 A 7/1958 Birdsall
4,482,291 A 11/1984 Chakrawarti et al.
(Continued)

FOREIGN PATENT DOCUMENTS

AU 2017220902 A1 10/2018
CN 106288148 A 1/2017
(Continued)

OTHER PUBLICATIONS

"Dynamic Airflow Balacing (DAB): Save Energy and Provide Comfort," 75F, 15 pages, 2018.
(Continued)

*Primary Examiner* — Nelson J Nieves
(74) *Attorney, Agent, or Firm* — Greenberg Traurig, LLP; Ryan D. Sharp; David J. Dykeman

(57) ABSTRACT

An HVAC controller may have an operational mode in which the HVAC controller provides operational instructions, and a commissioning mode in which a plurality of wireless devices can be enrolled. While in the commissioning mode, the HVAC controller is configured to accept a first input from a user via the user interface that designates a first zone of the plurality of zones and causes each of two or more first wireless devices that are subsequently placed in an enrollment mode by the user to be enrolled in the first zone, and to subsequently accept a second input from the user via the user interface that designates a second zone of the plurality of zones and causes each of two or more second wireless devices that are subsequently placed in an enrollment mode by the user to be enrolled in the second zone.

19 Claims, 15 Drawing Sheets

(51) Int. Cl.

| | |
|---|---|
| ***F24F 3/052*** | (2006.01) |
| ***F24F 11/58*** | (2018.01) |
| *F24F 120/20* | (2018.01) |
| *F24F 110/10* | (2018.01) |

(52) U.S. Cl.
CPC ..... *F24F 2110/10* (2018.01); *F24F 2120/20* (2018.01)

(56) References Cited

U.S. PATENT DOCUMENTS

| | | | |
|---|---|---|---|
| 4,949,625 | A | 8/1990 | Miklos |
| 5,520,328 | A | 5/1996 | Bujak, Jr. |
| 5,896,959 | A | 4/1999 | Jeffries et al. |
| 6,327,368 | B1 | 12/2001 | Yamaguchi et al. |
| 6,817,378 | B2 | 11/2004 | Zelczer |
| 6,983,889 | B2 | 1/2006 | Alles |
| 6,997,390 | B2 | 2/2006 | Alles |
| 7,455,236 | B2 | 11/2008 | Kates |
| 7,455,237 | B2 | 11/2008 | Kates |
| 7,543,759 | B2 | 6/2009 | George |
| 7,566,264 | B2 | 7/2009 | Votaw et al. |
| 7,663,844 | B2 | 2/2010 | Song et al. |
| 7,789,317 | B2 | 9/2010 | Votaw et al. |
| 7,832,465 | B2 | 11/2010 | Zou et al. |
| 8,033,479 | B2 | 10/2011 | Kates |
| 8,376,242 | B1 | 2/2013 | Uselton |
| 8,457,796 | B2 | 6/2013 | Thind |
| 8,695,888 | B2 | 4/2014 | Kates |
| 8,951,103 | B2 | 2/2015 | Votaw et al. |
| 8,956,207 | B2 | 2/2015 | Jackson |
| 9,091,280 | B2 | 7/2015 | Hopkins |
| 9,182,140 | B2 | 11/2015 | Kates |
| 9,194,599 | B2 | 11/2015 | Kates |
| 9,194,600 | B2 | 11/2015 | Kates |
| 9,222,692 | B2 | 12/2015 | Kates |
| 9,273,879 | B2 | 3/2016 | Kates |
| 9,303,889 | B2 | 4/2016 | Kates |
| 9,303,890 | B2 | 4/2016 | Haines et al. |
| 9,311,909 | B2 | 4/2016 | Giaimo, III et al. |
| 9,316,407 | B2 | 4/2016 | Kates |
| 9,353,963 | B2 | 5/2016 | Kates |
| 9,353,964 | B2 | 5/2016 | Kates |
| 9,441,847 | B2 | 9/2016 | Grohman |
| 9,618,222 | B1 | 4/2017 | Hussain et al. |
| 9,642,022 | B2 | 5/2017 | Hill et al. |
| 9,651,925 | B2 | 5/2017 | Fillbeck et al. |
| 9,723,380 | B2 | 8/2017 | Patel et al. |
| 9,835,348 | B2 | 12/2017 | Storm et al. |
| 9,854,335 | B2 | 12/2017 | Patel et al. |
| 9,995,497 | B2 | 6/2018 | Kates |
| 9,995,502 | B1 | 6/2018 | Reeder |
| 2004/0194484 | A1 | 10/2004 | Zou et al. |
| 2005/0270151 | A1 | 12/2005 | Winick |
| 2006/0186213 | A1 | 8/2006 | Carey et al. |
| 2008/0314260 | A1 | 12/2008 | Hardenburger |
| 2009/0008463 | A1 | 1/2009 | Holland et al. |
| 2009/0065595 | A1 | 3/2009 | Kates |
| 2009/0140058 | A1 | 6/2009 | Koster et al. |
| 2009/0140063 | A1 | 6/2009 | Koster et al. |
| 2010/0012737 | A1 | 1/2010 | Kates |
| 2010/0105312 | A1 | 4/2010 | Bamberger |
| 2011/0198404 | A1 | 8/2011 | Dropmann |
| 2012/0239208 | A1 | 9/2012 | Federspiel et al. |
| 2013/0261807 | A1 | 10/2013 | Zywicki et al. |
| 2014/0214212 | A1 | 7/2014 | Leen et al. |
| 2014/0324229 | A1 | 10/2014 | Leen et al. |
| 2014/0349566 | A1 | 11/2014 | Lamb et al. |
| 2015/0028113 | A1 | 1/2015 | Day |
| 2015/0159908 | A1 | 6/2015 | Votaw et al. |
| 2015/0300671 | A1 | 10/2015 | Coleman et al. |
| 2016/0091220 | A1 | 3/2016 | Kates |
| 2016/0153674 | A1 | 6/2016 | Lancaster |
| 2016/0291615 | A1 | 10/2016 | Zakaria |
| 2016/0333884 | A1 | 11/2016 | Hussain et al. |
| 2017/0089599 | A1 | 3/2017 | Hale |
| 2017/0124842 | A1 | 5/2017 | Sinha et al. |
| 2017/0176034 | A1 | 6/2017 | Hussain et al. |
| 2017/0177013 | A1 | 6/2017 | Malhotra et al. |
| 2017/0292725 | A1 | 10/2017 | Conley et al. |
| 2018/0129232 | A1 | 5/2018 | Hriljac et al. |
| 2018/0172308 | A1 | 6/2018 | Solanki |
| 2018/0217621 | A1 | 8/2018 | Biesterveld et al. |
| 2018/0266718 | A1 | 9/2018 | Gillette et al. |
| 2018/0320918 | A1 | 11/2018 | Kojima et al. |
| 2018/0347578 | A1 | 12/2018 | Hancock |
| 2019/0145648 | A1 | 5/2019 | Sinha et al. |
| 2020/0072543 | A1 | 3/2020 | Turney |
| 2020/0116377 | A1 | 4/2020 | Heintzelman et al. |
| 2020/0173680 | A1 | 6/2020 | Gonia et al. |
| 2020/0201368 | A1 | 6/2020 | Eicher |

FOREIGN PATENT DOCUMENTS

| | | | |
|---|---|---|---|
| CN | 106369788 | A | 2/2017 |
| GB | 565714 | A | 11/1944 |
| WO | 2015134987 | A1 | 9/2015 |
| WO | 2019035051 | A1 | 2/2019 |
| WO | 2019175768 | A1 | 9/2019 |

OTHER PUBLICATIONS

"Smart VAV with Reheat: A unique system-wide approach to maximizing performance," 75F, 12 pages, 2018.
Singh, "9 Considerations When Employing IOT," 75F, 6 pages, retrieved 2018.
Singh, "The Internet of Comfort," 75F, 6 pages, retrieved 2018.
Singh, "The EMS is Dead," 75F, 4 pages, retrieved 2018.
"Technology Brief," 75F, 4 pages, retrieved 2018.
"Technology Brief," 5 pages, retrieved 2018.
Murthy et al., "Active Noise Control of a Radial Fan," Blekinge Institute of Technology, 66 pages, Dec. 2008.
"Back-EMF Motion Feedback Blog Post," Acroname, 7 pages, Apr. 17, 2011.
"Dampers," Arzel Zoning, 7 pages, 2016.
"Under Pressure: Why Dynamic Monitoring is Essential to Residential HVAC Zoning and Vent Control," Ecovent Corp, 14 pages, Mar. 2014.
"Specification Sheet," Aprilaire, 2 pages, 2005.
"Smart Vent," Google Image Search, 16 pages, retrieved 2018.
"Flair for Central Heating and Cooling," Flair, 7 pages, 2018.
"Residential Communicating Control System: iComfort Ultra Smart Thermostat S30," Lennox, 32 pages, Aug. 2017.
Response to European Communication from corresponding Application Serial No. 19213370.0 filed on Dec. 10, 2020 (47 pp).
Extended European Search Report from corresponding European Application No. 19213370.0 dated Apr. 21, 2020 (8 pp).
Prosecution History from U.S. Appl. No. 16/208,471, dated May 27, 2020 through May 12, 2021, 41 pp.

HVAC CONTROLLER WITH A ZONE COMMISSIONING MODE

This application is a continuation of U.S. patent application Ser. No. 16/208,471, which was filed on Dec. 3, 2018, was assigned patent Ser. No. 11/112,139 issued Sep. 7, 2021 and is entitled, "HVAC CONTROLLER WITH A ZONE COMMISSIONING MODE." The entire content of U.S. patent application Ser. No. 16/208,471 is incorporated herein by reference.

TECHNICAL FIELD

The present disclosure pertains to a Heating, Ventilation, and/or Air Conditioning (HVAC) system for a building. More particularly, the present disclosure pertains to devices for controlling an HVAC system.

BACKGROUND

Heating, Ventilation, and/or Air Conditioning (HVAC) systems are often used to control the comfort level within a building or other structure. Such HVAC systems typically include an HVAC controller that controls various HVAC components of the HVAC system in order to affect and/or control one or more environmental conditions within the building. In many cases, the HVAC controller is mounted within the building and provides control signals to various HVAC components of the HVAC system. Improvements in the hardware, user experience, and functionality of such HVAC controllers, including commissioning of such HVAC controllers, would be desirable.

SUMMARY

The disclosure is directed to HVAC controllers that are configured to receive signals such as temperature signals from a plurality of different temperature sensors, and to utilize these temperature signals in controlling an HVAC system. In a particular example of the disclosure, a Heating, Ventilation and Air Conditioning (HVAC) controller is configured to control a zoned HVAC system that includes a plurality of wireless devices that are divided into a plurality of zones within a building supported by the zoned HVAC system. The illustrative HVAC controller includes a housing and a user interface that is accessible from an exterior of the housing. A controller is operably coupled to the user interface and is configured to include an operational mode in which the controller provides operational instructions to the zoned HVAC system, and a commissioning mode in which the plurality of wireless devices can be enrolled into a particular zone of the plurality of zones. While in the commissioning mode, the controller may be configured to accept a first input from a user via the user interface that designates a first zone of the plurality of zones and causes each of one or more first wireless devices that are subsequently placed in an enrollment mode by the user to be enrolled in the first zone and to accept a second input from the user via the user interface that designates a second zone of the plurality of zones and causes each of one or more second wireless devices that are subsequently placed in an enrollment mode by the user to be enrolled in the second zone. The controller is further configured to control the zoned HVAC system using the enrolled wireless devices.

In another example of the disclosure, a method of enrolling a plurality of wireless devices into a zoned HVAC system having a plurality of zones includes accepting a first input from a user via a user interface that designates a first zone of the plurality of zones and after accepting the first input, enrolling each of one or more first wireless devices that are subsequently placed in an enrollment mode by the user in the first zone. The illustrative method further includes accepting a second input from the user via the user interface that designates a second zone of the plurality of zones and after accepting the second input, enrolling each of one or more second wireless devices that are subsequently placed in an enrollment mode by the user in the second zone. The zoned HVAC system is controlled using the enrolled wireless devices.

In another example of the disclosure, a Heating, Ventilation and Air Conditioning (HVAC) controller is configured to control a zoned HVAC system that includes a plurality of wireless devices that are divided into a plurality of zones within a building supported by the zoned HVAC system. The HVAC controller includes a housing that is configured to be releasably securable to a wall plate that enables electrical connections between the HVAC controller and field wires that extend to the zoned HVAC system. A plurality of terminal pins extend backward from the housing and are configured to operably couple with one or more terminal blocks that are disposed on the wall plate and are connectable to the field wires. A portable power supply is configured to engage two or more of the plurality of terminal pins when the housing is released from the wall plate and is releasably attached to the portable power supply. The portable power supply is configured to power operation of the HVAC controller while the HVAC controller is released from the wall plate. The illustrative HVAC controller includes a user interface that is housed by the housing and is accessible from an exterior of the housing. A controller is operably coupled to the user interface and is configured to include an operational mode in which the controller provides operational instructions to the zoned HVAC system and a commissioning mode in which the plurality of wireless devices can be enrolled into a particular zone of the plurality of zones. While the HVAC controller is in the commissioning mode and while the HVAC controller is powered by the portable power supply, the controller provides communication with the plurality of wireless devices such that the user interface of the HVAC controller may be used to enroll each installed wireless device into a designated zone while an installer takes the HVAC controller from zone to zone as they install each of the plurality of wireless devices. The controller is further configured to control the zoned HVAC system using the enrolled wireless devices.

The above summary of some embodiments is not intended to describe each disclosed embodiment or every implementation of the present disclosure. The Figures, and Detailed Description, which follow, more particularly exemplify some of these embodiments.

BRIEF DESCRIPTION OF THE DRAWINGS

The disclosure may be more completely understood in consideration of the following description of various illustrative embodiments of the disclosure in connection with the accompanying drawings, in which.

Figure 1:
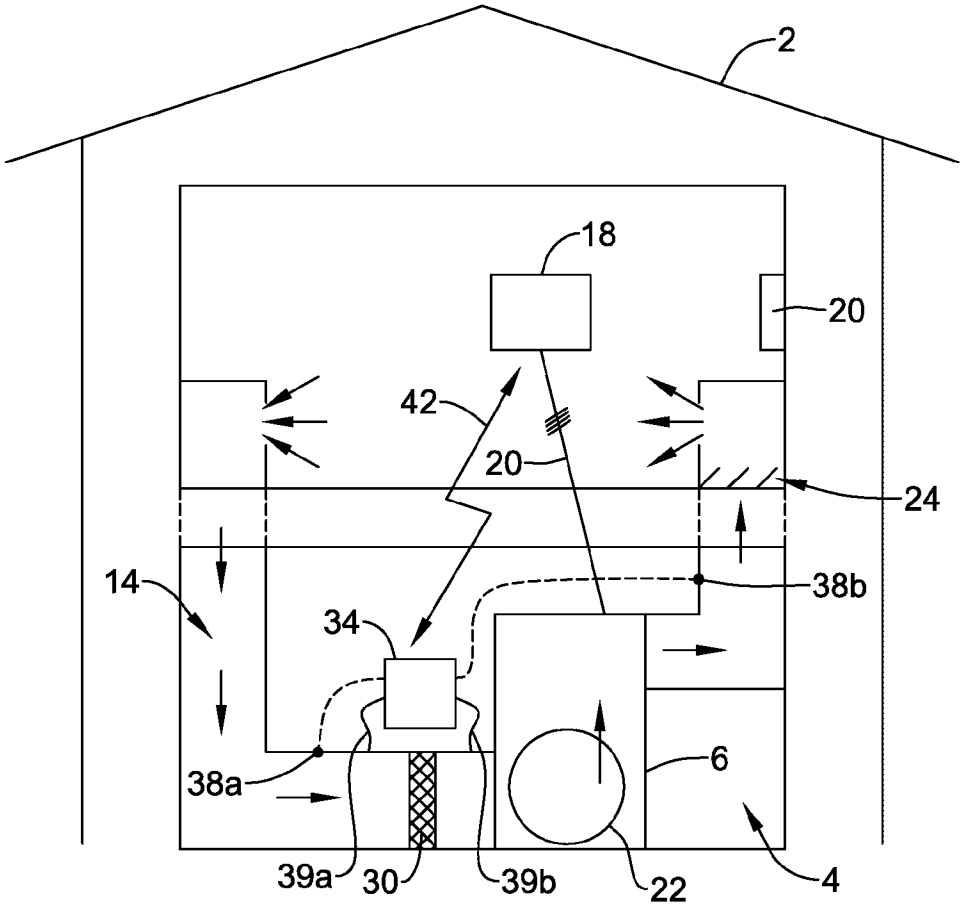
FIG. 1 is a schematic view of an illustrative HVAC system servicing a building.

While the disclosure is amenable to various modifications and alternative forms, specifics thereof have been shown by way of example in the drawings and will be described in detail. It should be understood, however, that the intention is not to limit aspects of the disclosure to the particular illustrative embodiments described. On the contrary, the intention is to cover all modifications, equivalents, and alternatives falling within the spirit and scope of the disclosure.

DESCRIPTION

The following description should be read with reference to the drawings wherein like reference numerals indicate like elements. The drawings, which are not necessarily to scale, are not intended to limit the scope of the disclosure. In some of the figures, elements not believed necessary to an understanding of relationships among illustrated components may have been omitted for clarity.

All numbers are herein assumed to be modified by the term "about", unless the content clearly dictates otherwise. The recitation of numerical ranges by endpoints includes all numbers subsumed within that range (e.g., 1 to 5 includes 1, 1.5, 2, 2.75, 3, 3.80, 4, and 5).

As used in this specification and the appended claims, the singular forms "a", "an", and "the" include the plural referents unless the content clearly dictates otherwise. As used in this specification and the appended claims, the term "or" is generally employed in its sense including "and/or" unless the content clearly dictates otherwise.

It is noted that references in the specification to "an embodiment", "some embodiments", "other embodiments", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is contemplated that the feature, structure, or characteristic may be applied to other embodiments whether or not explicitly described unless clearly stated to the contrary.

The present disclosure is directed generally at building automation systems. Building automation systems are systems that control one or more operations of a building. Building automation systems can include HVAC systems, security systems, fire suppression systems, energy management systems and other systems. While HVAC systems with HVAC controllers are used as an example below, it should be recognized that the concepts disclosed herein can be applied to building automation systems more generally.

FIG. 1 is a schematic view of a building 2 having an illustrative heating, ventilation, and air conditioning (HVAC) system 4. The illustrative HVAC system 4 of FIG. 1 includes one or more HVAC components 6, a system of ductwork and air vents including a supply air duct 10 and a return air duct 14, and one or more HVAC controllers 18. The one or more HVAC components 6 may include, but are not limited to, a furnace, a heat pump, an electric heat pump, a geothermal heat pump, an electric heating unit, an air conditioning unit, a humidifier, a dehumidifier, an air exchanger, an air cleaner, a damper, a valve, and/or the like.

It is contemplated that the HVAC controller(s) 18 may be configured to control the comfort level in the building or structure by activating and deactivating the HVAC component(s) 6 in a controlled manner. The HVAC controller(s) 18 may be configured to control the HVAC component(s) 6 via a wired or wireless communication link 20. In some cases, the HVAC controller(s) 18 may be a thermostat, such as, for example, a wall mountable thermostat, but this is not required in all embodiments. Such a thermostat may include (e.g. within the thermostat housing) or have access to one or more temperature sensor(s) for sensing ambient temperature at or near the thermostat. In some instances, the HVAC controller(s) 18 may be a zone controller, or may include multiple zone controllers each monitoring and/or controlling the comfort level within a particular zone in the building or other structure. In some cases, the HVAC controller(s) 18 may communicate with one or more remote sensors, such as a remote sensor 21, that may be disposed within the building 2. In some cases, a remote sensor 21 may measure various environmental conditions such as but not limited to temperature.

In the illustrative HVAC system 4 shown in FIG. 1, the HVAC component(s) 6 may provide heated air (and/or cooled air) via the ductwork throughout the building 2. As illustrated, the HVAC component(s) 6 may be in fluid communication with every room and/or zone in the building 2 via the ductwork 10 and 14, but this is not required. In operation, when a heat call signal is provided by the HVAC controller(s) 18, an HVAC component 6 (e.g. forced warm air furnace) may be activated to supply heated air to one or more rooms and/or zones within the building 2 via supply air ducts 10. The heated air may be forced through supply air duct 10 by a blower or fan 22. In this example, the cooler air from each zone may be returned to the HVAC component 6 (e.g. forced warm air furnace) for heating via return air ducts 14. Similarly, when a cool call signal is provided by the HVAC controller(s) 18, an HVAC component 6 (e.g. air conditioning unit) may be activated to supply cooled air to one or more rooms and/or zones within the building or other structure via supply air ducts 10. The cooled air may be forced through supply air duct 10 by the blower or fan 22. In this example, the warmer air from each zone may be returned to the HVAC component 6 (e.g. air conditioning unit) for cooling via return air ducts 14. In some cases, the HVAC system 4 may include an internet gateway or other device 23 that may allow one or more of the HVAC components, as described herein, to communicate over a wide area network (WAN) such as, for example, the Internet.

In some cases, the system of vents or ductwork 10 and/or 14 can include one or more dampers 24 to regulate the flow of air, but this is not required. For example, one or more dampers 24 may be coupled to one or more HVAC controller (s) 18, and can be coordinated with the operation of one or more HVAC components 6. The one or more HVAC controller(s) 18 may actuate dampers 24 to an open position, a closed position, and/or a partially open position to modulate the flow of air from the one or more HVAC components to an appropriate room and/or zone in the building or other structure. The dampers 24 may be particularly useful in zoned HVAC systems, and may be used to control which zone(s) receives conditioned air and/or receives how much conditioned air from the HVAC component(s) 6. In some cases, the one or more HVAC controller(s) 18 may use information from the one or more remote sensors 21, which may be disposed within one or more zones, to adjust the position of one or more of the dampers 24 in order to cause a measured value to approach a set point in a particular zone or zones.

In many instances, one or more air filters 30 may be used to remove dust and other pollutants from the air inside the building 2. In the illustrative example shown in FIG. 1, the air filter(s) 30 is installed in the return air duct 14, and may filter the air prior to the air entering the HVAC component 6, but it is contemplated that any other suitable location for the air filter(s) 30 may be used. The presence of the air filter(s) 30 may not only improve the indoor air quality, but may also protect the HVAC components 6 from dust and other particulate matter that would otherwise be permitted to enter the HVAC component.

In some cases, and as shown in FIG. 1, the illustrative HVAC system 4 may include an equipment interface module (EIM) 34. When provided, the equipment interface module 34 may, in addition to controlling the HVAC under the direction of the thermostat, be configured to measure or detect a change in a given parameter between the return air side and the discharge air side of the HVAC system 4. For example, the equipment interface module 34 may measure a difference (or absolute value) in temperature, flow rate, pressure, or a combination of any one of these parameters between the return air side and the discharge air side of the HVAC system 4. In some instances, absolute value is useful in protecting equipment against an excessively high temperature or an excessively low temperature, for example. In some cases, the equipment interface module 34 may be adapted to measure the difference or change in temperature (delta T) between a return air side and discharge air side of the HVAC system 4 for the heating and/or cooling mode. The delta T for the heating and cooling modes may be calculated by subtracting the return air temperature from the discharge air temperature (e.g. delta T=discharge air temperature−return air temperature).

In some cases, the equipment interface module 34 may include a first temperature sensor 38*a* located in the return (incoming) air duct 14, and a second temperature sensor 38*b* located in the discharge (outgoing or supply) air duct 10. Alternatively, or in addition, the equipment interface module 34 may include a differential pressure sensor including a first pressure tap 39*a* located in the return (incoming) air duct 14, and a second pressure tap 39*b* located downstream of the air filter 30 to measure a change in a parameter related to the amount of flow restriction through the air filter 30. In some cases, it can be useful to measure pressure across the fan in order to determine if too much pressure is being applied as well as to measure pressure across the cooling A-coil in order to determine if the cooling A-coil may be plugged or partially plugged. In some cases, the equipment interface module 34, when provided, may include at least one flow sensor that is capable of providing a measure that is related to the amount of air flow restriction through the air filter 30. In some cases, the equipment interface module 34 may include an air filter monitor. These are just some examples.

When provided, the equipment interface module 34 may be configured to communicate with the HVAC controller 18 via, for example, a wired or wireless communication link 42. In other cases, the equipment interface module 34 may be incorporated or combined with the HVAC controller 18. In some instances, the equipment interface module 34 may communicate, relay or otherwise transmit data regarding the selected parameter (e.g. temperature, pressure, flow rate, etc.) to the HVAC controller 18. In some cases, the HVAC controller 18 may use the data from the equipment interface module 34 to evaluate the system's operation and/or performance. For example, the HVAC controller 18 may compare data related to the difference in temperature (delta T) between the return air side and the discharge air side of the HVAC system 4 to a previously determined delta T limit stored in the HVAC controller 18 to determine a current operating performance of the HVAC system 4. In other cases, the equipment interface module 34 may itself evaluate the system's operation and/or performance based on the collected data.

Figure 2:
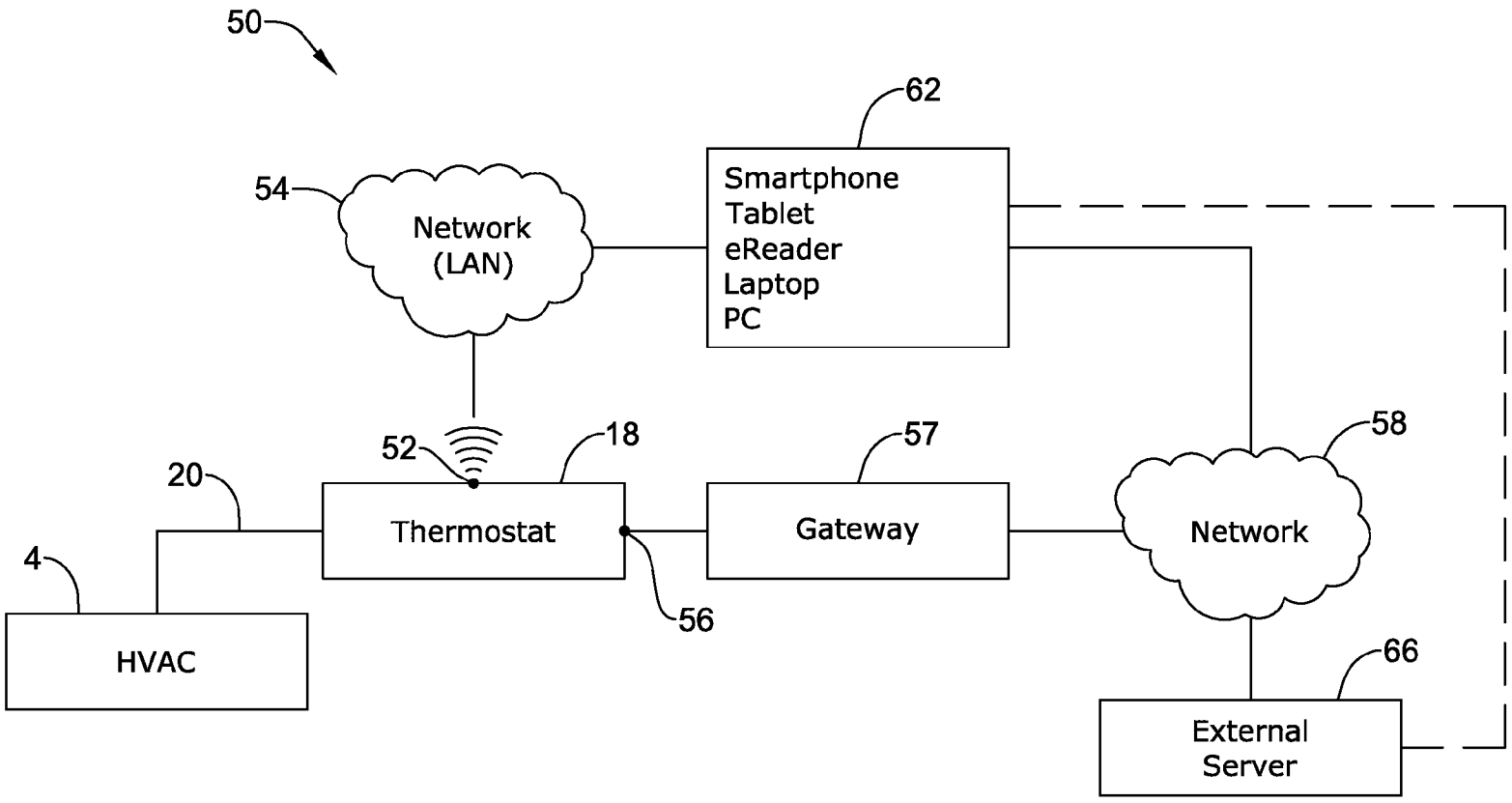
FIG. 2 is a schematic view of an illustrative HVAC control system that may facilitate access and/or control of the HVAC system of FIG. 1.

FIG. 2 is a schematic view of an illustrative HVAC control system 50 that facilitates remote access and/or control of the illustrative HVAC system 4 shown in FIG. 1. The HVAC control system 50 may be considered a building automation system or part of a building automation system. The illustrative HVAC control system 50 includes an HVAC controller, as for example, HVAC controller 18 (see FIG. 1) that is configured to communicate with and control one or more HVAC components 6 of the HVAC system 4. As discussed above, the HVAC controller 18 may communicate with the one or more HVAC components 6 of the HVAC system 4 via a wired or wireless communication link 20. Additionally, the HVAC controller 18 may communicate over one or more wired or wireless networks that may accommodate remote access and/or control of the HVAC controller 18 via another device such as a smart phone, tablet, e-reader, laptop computer, personal computer, key fob, or the like. As shown in FIG. 2, the HVAC controller 18 may include a first communications port 52 for communicating over a first network 54, and in some cases, a second communications port 56 for communicating over a second network 58. In some cases, the first network 54 may be a wireless local area network (LAN), and the second network 58 (when provided) may be a wide area network or global network (WAN) including, for example, the Internet. In some cases, the wireless local area network 54 may provide a wireless access point and/or a network host device that is separate from the HVAC controller 18. In other cases, the wireless local area network 54 may provide a wireless access point and/or a network host device that is part of the HVAC controller 18. In some cases, the wireless local area network 54 may include a local domain name server (DNS), but this is not required for all embodiments. In some cases, the wireless local area network 54 may be an ad-hoc wireless network, but this is not required.

In some cases, the HVAC controller 18 may be programmed to communicate over the second network 58 with an external web service hosted by one or more external web server(s) 66. A non-limiting example of such an external web service is Honeywell's TOTAL CONNECT™ web service. The HVAC controller 18 may be configured to upload selected data via the second network 58 to the external web service where it may be collected and stored on the external web server 66. In some cases, the data may be indicative of the performance of the HVAC system 4. Additionally, the HVAC controller 18 may be configured to receive and/or download selected data, settings and/or services sometimes including software updates from the external web service over the second network 58. The data, settings and/or services may be received automatically from the web service, downloaded periodically in accordance with a control algorithm, and/or downloaded in response to a user request. In some cases, for example, the HVAC controller 18 may be configured to receive and/or download an HVAC operating schedule and operating parameter settings such as, for example, temperature set points, humidity set points, start times, end times, schedules, window frost protection settings, and/or the like from the web server 66 over the second network 58. In some instances, the HVAC controller 18 may be configured to receive one or more user profiles having at least one operational parameter setting that is selected by and reflective of a user's preferences. In still other instances, the HVAC controller 18 may be configured to receive and/or download firmware and/or hardware updates such as, for example, device drivers from the web server 66 over the second network 58. Additionally, the HVAC controller 18 may be configured to receive local weather data, weather alerts and/or warnings, major stock index ticker data, traffic data, and/or news headlines over the second network 58. These are just some examples.

Depending upon the application and/or where the HVAC user is located, remote access and/or control of the HVAC controller 18 may be provided over the first network 54 and/or the second network 58. A variety of remote wireless devices 62 may be used to access and/or control the HVAC controller 18 from a remote location (e.g. remote from the HVAC Controller 18) over the first network 54 and/or second network 58 including, but not limited to, mobile phones including smart phones, tablet computers, laptop or personal computers, wireless network-enabled key fobs, e-readers, and/or the like. In many cases, the remote wireless devices 62 are configured to communicate wirelessly over the first network 54 and/or second network 58 with the HVAC controller 18 via one or more wireless communication protocols including, but not limited to, cellular communication, ZigBee, REDLINK™, Bluetooth, WiFi, IrDA, dedicated short range communication (DSRC), EnOcean, and/or any other suitable common or proprietary wireless protocol, as desired. In some cases, the remote wireless devices 62 may communicate with the network 54 via the external server 66 for security purposes, for example.

In some cases, an application program code (i.e. app) stored in the memory of the remote wireless device 62 may be used to remotely access and/or control the HVAC controller 18. The application program code (app) may be downloaded from an external web service, such as the web service hosted by the external web server 66 (e.g. Honeywell's TOTAL CONNECT™ web service) or another external web service (e.g. ITUNES® or Google Play). In some cases, the app may provide a remote user interface for interacting with the HVAC controller 18 at the user's remote wireless device 62. For example, through the user interface provided by the app, a user may be able to change operating parameter settings such as, for example, temperature set points, humidity set points, start times, end times, schedules, window frost protection settings, accept software updates and/or the like. Communications may be routed from the user's remote wireless device 62 to the web server 66 and then, from the web server 66 to the HVAC controller 18. In some cases, communications may flow in the opposite direction such as, for example, when a user interacts directly with the HVAC controller 18 to change an operating parameter setting such as, for example, a schedule change or a set point change. The change made at the HVAC controller 18 may be routed to the web server 66 and then from the web server 66 to the remote wireless device 62 where it may reflected by the application program executed by the remote wireless device 62.

In some cases, a user may be able to interact with the HVAC controller 18 via a user interface provided by one or more web pages served up by the web server 66. The user may interact with the one or more web pages using a variety of internet capable devices to effect a setting or other change at the HVAC controller 18, and in some cases view usage data and energy consumption data related to the usage of the HVAC system 4. In some cases, communication may occur between the user's remote wireless device 62 and the HVAC controller 18 without being relayed through a server such as external server 66. These are just some examples.

Figure 3:
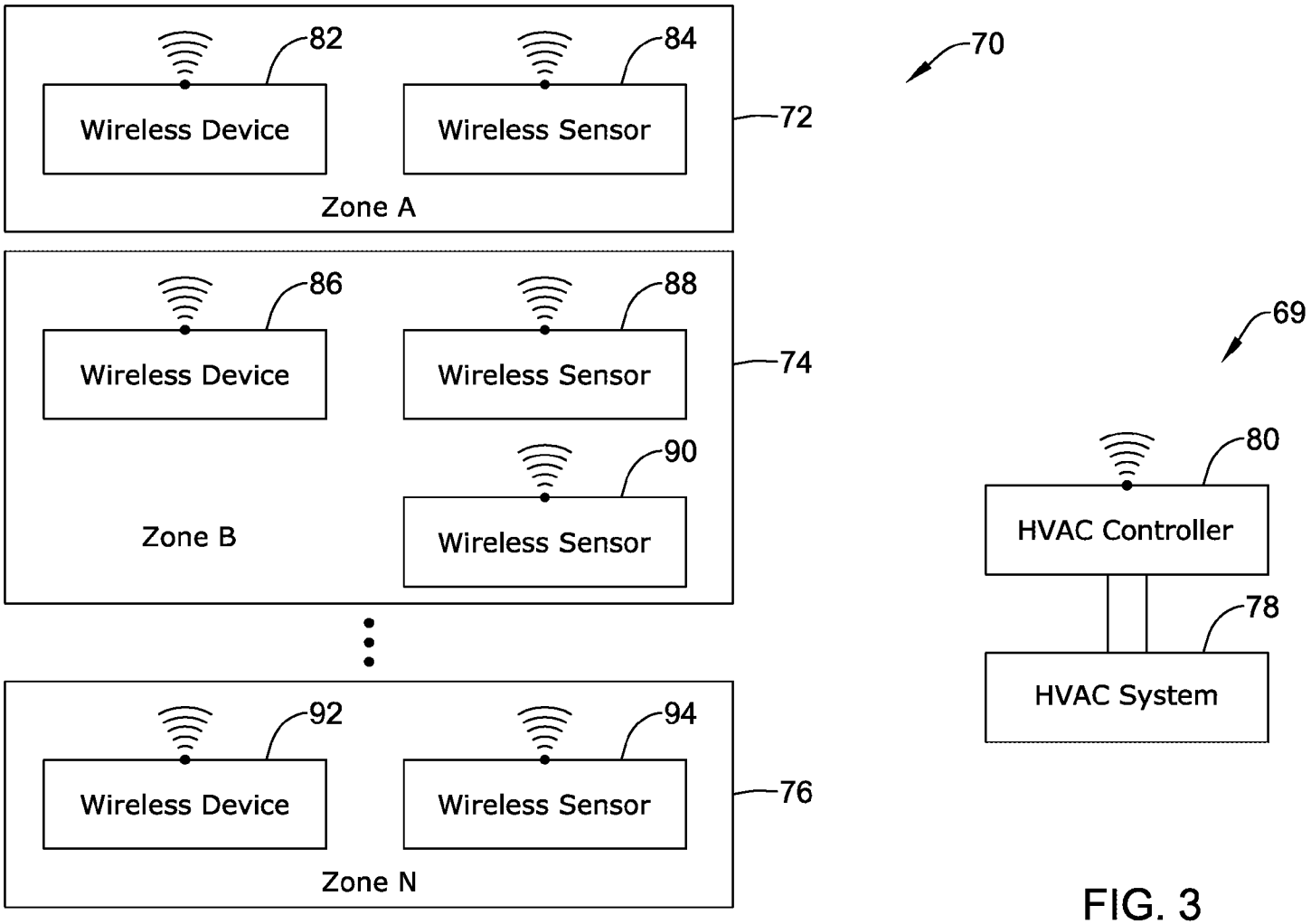
FIG. 3 is a schematic view of an illustrative HVAC system divided into a plurality of zones.

FIG. 3 is a schematic view of a building 70 that includes a zoned HVAC system 69 that is divided into multiple zones. The zoned HVAC system 69 may include an HVAC controller 80, an HVAC system 78, and wireless devices 82, 84, 86, 88, 90, 92 and 94 assigned to zones A 72, B 74 and N 76. The term wireless devices may include wireless dampers, wireless sensors and/or any other suitable wireless device. It will be appreciated that that the building 70 may include attributes, equipment and features referenced with respect to the building 2 (FIG. 1). As illustrated, the building 70 has been divided into a ZONE A, labeled as 72; a Zone B, labeled as 74 and any number of additional zones through a ZONE N, labeled as 76. In some cases, each of the zones 72, 74, 76 may represent a distinct room within the building 70. At least some of the zones 72, 74, 76 may represent areas that are larger than a single room. In some instances, at least some of the zones 72, 74, 76 may represent different floors within the building 70. These are just examples. The building 70 includes an HVAC system 78 that provides conditioned air through supply ducts to each of the zones 72, 74, 76, and an HVAC controller 80 that controls operation of the HVAC system 78. In some cases, the HVAC system 78 may be representative of the HVAC system 4 (FIG. 1). The HVAC controller 80 may be representative of the HVAC controller 18 (FIG. 1). In some cases, each of the zones 72, 74, 76 may be seen as including wireless devices as shown.

In the example shown, ZONE A, labeled as 72, includes a wireless device 82 and a wireless sensor 84. In some cases, the wireless device 82 may be a wireless damper that fits into a supply duct providing conditioned air to ZONE A. The wireless sensor 84 may include a temperature sensor. In some cases, the wireless sensor 84 may additionally or alternatively include one or more of a humidity sensor, an air quality sensor and the like. ZONE B, labeled as 74, includes a wireless device 86, a wireless sensor 88 and a wireless sensor 90. The Zone N, labeled as 76, includes a wireless device 92 and a wireless sensor 94. It will be appreciated that this is merely illustrative, as a particular zone may include one, two or more distinct wireless devices, and may include more wireless devices and/or sensors than are illustrated.

In some instances, the wireless sensors 84, 88, 90, 94 communicate directly with the respective wireless devices 82, 86, 92. In some cases, the wireless devices 82, 86, 92 and the wireless sensors 84, 88, 90, 94 do not communicate directly with each other, but instead each communicate with the HVAC controller 80. As an example, the wireless sensors 84, 88, 90, 94 may report current air temperatures to the HVAC controller 80, which in turn determines whether to actuate one or more of the wireless devices 82, 86, 92 (e.g. dampers), and subsequently provides appropriate instructions to one or more of the wireless devices 82, 86, 92 (e.g. change position of a damper).

Figure 4:
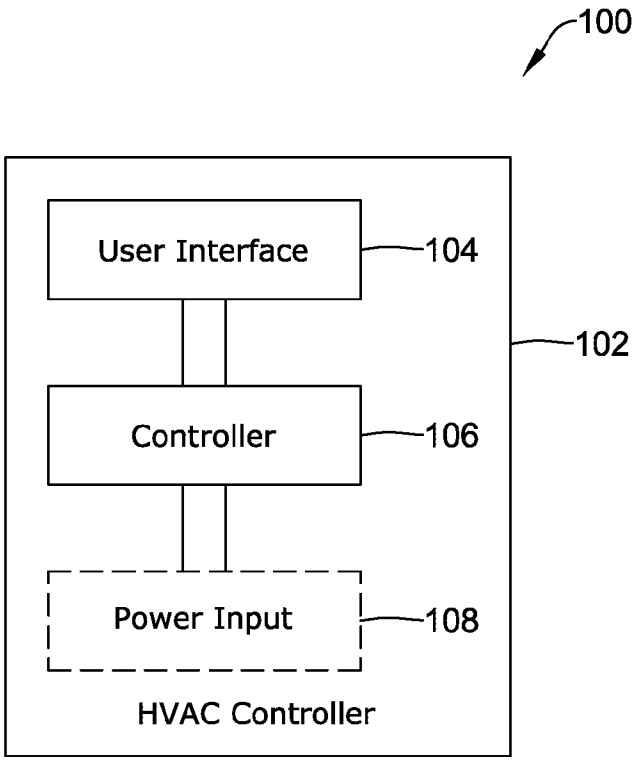
FIG. 4 is a schematic view of an illustrative HVAC controller.

FIG. 4 is a schematic diagram of an HVAC controller 100 that may be configured to control a zoned HVAC system that includes a plurality of wireless devices divided into a plurality of zones within a building supported by the zoned HVAC system, such as but not limited to that shown in FIG. 3. The illustrative HVAC controller 100 includes a housing 102 and a user interface 104 that is accessible from a position exterior of the housing 102. The user interface 104 may be housed by the housing 102, but this is not required in all cases. For example, the user interface 104 may instead be remote from the housing 102 yet in communication with the HVAC controller 100. As an illustrative but non-limiting example, the user interface 104 may be part of a smartphone or a tablet that is in communication with the HVAC controller 100.

A controller 106 is operably coupled to the user interface 104 and includes an operation mode in which the controller 106 provides operational instructions to the HVAC system (e.g. HVAC system 78 of FIG. 3), and a commissioning mode in which the plurality of wireless devices/sensors (e.g. wireless devices 82, 84, 86, 88, 90, 92 and 94 of FIG. 3) can be enrolled into a particular zone of the plurality of zones of the zoned HVAC system 69. In some cases, the HVAC controller 100 may include a power input 108 for receiving power from a power source to power the HVAC controller 100. In some instances, the power source may be line power (e.g. 110V, 24V, etc.) that is delivered through one or more wires to the power input 108 of the HVAC controller 100. Alternatively, the power source may include a portable power pack that is removably attachable to the HVAC controller 100 in order to deliver power to the power input 108 of the HVAC controller 100 while the HVAC controller 100 is carried about the building 70. The portable power pack may include a battery, for example.

While the controller 106 is in the commissioning mode, the controller 106 may be configured to accept a first input from a user via the user interface 104 that designates a first zone of the plurality of zones and causes each of two or more first wireless devices that are subsequently placed in an enrollment mode by the user to be enrolled in the first zone. The controller 106 may further be configured to accept a second input from the user via the user interface 104 that designates a second zone of the plurality of zones and causes each of two or more second wireless devices that are subsequently placed in an enrollment mode by the user to be enrolled in the second zone. Subsequently, when in the operation mode, the controller 106 is configured to control the zoned HVAC system 69 using the enrolled wireless devices.

In some instances, the controller 106 may be configured, when in the commissioning mode and with the first zone designated, to help the user identify a location of a first one of the two or more first wireless devices that are enrolled in the first zone by sending a command to the first one of the two or more first wireless devices that causes the first one of the two or more first wireless devices to output an audible and/or visual indicator that can be perceived by the user. In some cases, the controller 106 may be configured to also help the user identify a location of a second one of the two or more first wireless devices that are enrolled in the first zone by sending a command to the second one of the two or more first wireless devices that causes the second one of the two or more first wireless devices to output an audible and/or visual indicator that can be perceived by the user.

In some instances, when the HVAC controller 100 is in the commissioning mode and the first zone is designated, the controller 106 may be further configured to help the user change a first one of the two or more first wireless devices that are enrolled in the first zone from a first state to a second state by sending a command that causes the first one of the two or more first wireless devices to change from the first state to the second state (e.g. change a damper to a closed state, an open state, a designated partially open state, etc.). In some cases, the controller 106 may also help the user change a second one of the two or more first wireless devices that are enrolled in the first zone from a first state to a second state by sending a command that causes the second one of the two or more first wireless devices enrolled in the first zone to change from a first state to a second state (e.g. change a damper to a closed state, an open state, a designated partially open state, etc.). When in the commissioning mode with the second zone designated, the controller 106 may be configured to help the user change a first one of the two or more first wireless devices that are enrolled in the second zone from a first state to a second state by sending a command that causes the first one of the two or more first wireless devices to change from the first state to the second state (e.g. change a damper to a closed state, an open state, a designated partially open state, etc.). In some cases, the controller 106 may also help the user change a second one of the two or more first wireless devices that are enrolled in the second zone from a first state to a second state by sending a command that causes the second one of the two or more first wireless devices enrolled in the second zone to change from a first state to a second state (e.g. change a damper to a closed state, an open state, a designated partially open state, etc.). These are just examples.

In some cases, the controller 106 may be configured to provide a list of enrolled wireless devices on the user interface 104. If one of the enrolled wireless devices was accidently enrolled into an incorrect zone, the controller 106 may be configured to enable a user to move a particular enrolled wireless device from one zone to another zone. In some cases, the controller 106 may be configured to enable a user to update the zone designation for a particular one of the plurality of wireless devices when a decision is made to change how one or more of the plurality of wireless devices are divided into zones.

In some cases, the controller 106 may be configured to receive one or more status indications from each of two or more of the enrolled wireless devices, and to display one or more corresponding status indicators on a display of the user interface 104. The status indicators may be displayed in a manner that associates the status indicators with the corresponding enrolled wireless device. For example, status indicators that may be displayed may include one or more of a sensed temperature, an indication of a damper position, a signal strength, an online connection status, a battery charge status, and/or any other suitable status indicator. At least some of the plurality of wireless devices may include wireless remote temperature sensors that are configured to be distributed about the building, and when in the operational mode, the controller 106 may be configured to operate the zoned HVAC system in accordance with temperature signals received from the wireless remote temperature sensors. In some cases, at least some of the plurality of wireless devices include remote dampers, and when in the operational mode, the controller 106 may be configured to provide operational instructions to the remote dampers in order to operate the zoned HVAC system in accordance with temperature signals from the wireless remote temperature sensors.

Figure 5:
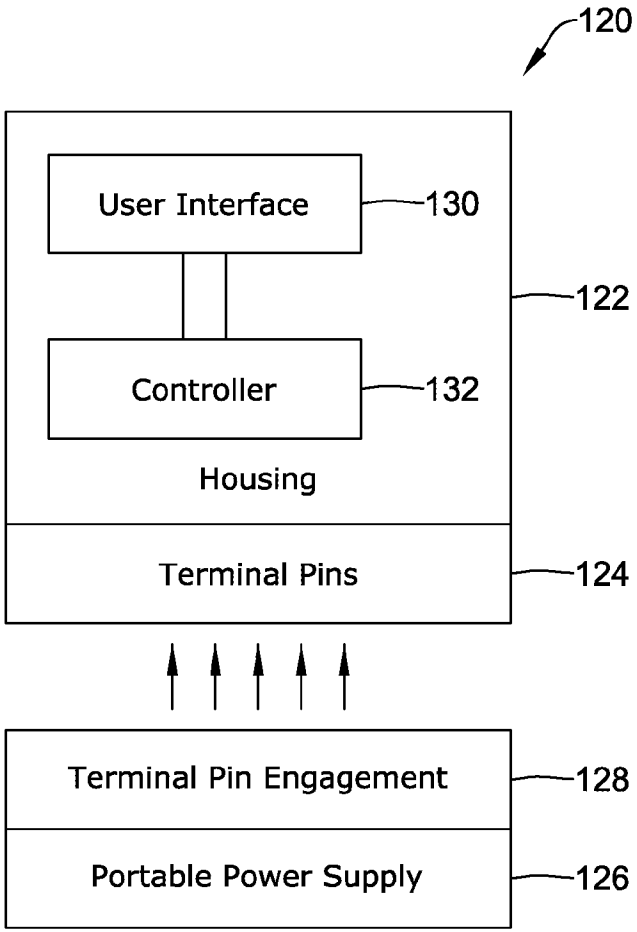
FIG. 5 is a schematic view of an illustrative HVAC controller.
Figure 8:
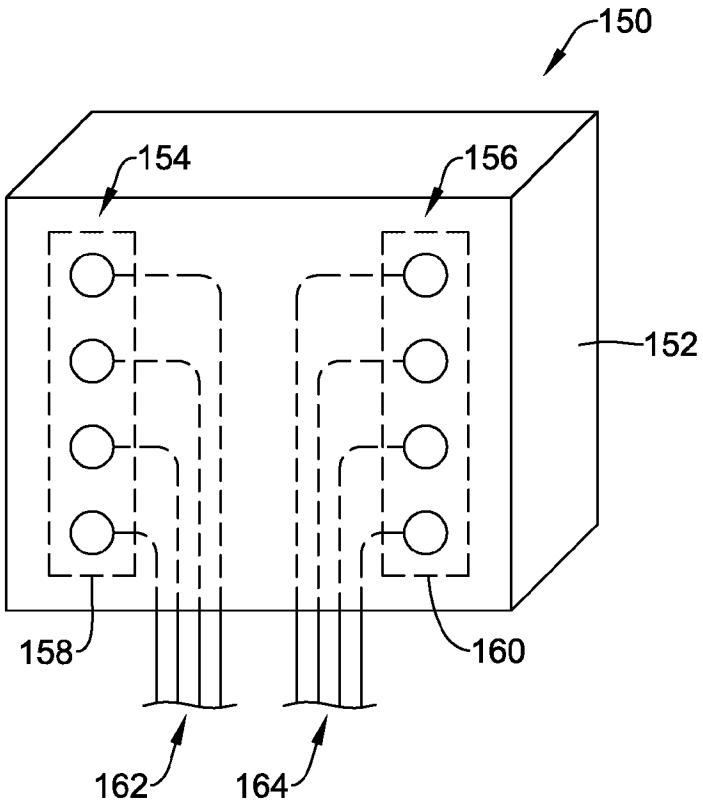
FIG. 8 is a front perspective view of an illustrative wall plate to which the illustrative HVAC controller of FIG. 6 may be coupled.

FIG. 5 is a schematic diagram of an HVAC controller 120 that may be configured to control a zoned HVAC system that includes a plurality of wireless devices divided into a plurality of zones within a building supported by the zoned HVAC system, such as but not limited to that shown in FIG. 3. The HVAC controller 120 includes a housing 122 that is configured to be releasably securable to a wall plate 150 (as shown in FIG. 8) that enables electrical connections between the HVAC controller 120 and field wires that extend to the HVAC system (such as but not limited to the HVAC system 4 of FIG. 1 and/or the HVAC system 78 of FIG. 3). A plurality of terminal pins 124, shown schematically as extending from the housing 122, extend backward from the housing 122 and are configured to operably coupled with one or more terminal blocks disposed on the wall plate 150. A portable power supply 126 is configured to engage two or more of the plurality of terminal pins 124, schematically including a terminal pin engagement 128, when the housing 122 has been removed from the wall plate 150. The portable power supply 126 may be configured to supply power that powers operation of the HVAC controller 120 when the HVAC controller 120 is removed from the wall plate 150 and carried about the building 70.

The illustrative HVAC controller 120 includes a user interface 130 that is housed by the housing 122 and that is accessible from an exterior of the housing 122. A controller 132 is operably coupled to the user interface 130 and is configured to include an operational mode in which the controller 132 provides operational instructions to the HVAC system 78, and a commissioning mode in which the plurality of wireless devices can be enrolled into a particular zone of the plurality of zones. While the HVAC controller 120 is in the commissioning mode and is being powered by the portable power supply 126, an installer may take the HVAC controller 120 from zone to zone as they install each of the plurality of wireless devices and may enroll each installed wireless device into a designated zone. The controller 132 may further be configured to control the zoned HVAC system 69 using the enrolled wireless devices.

In some cases, while the HVAC controller 120 is in the commissioning mode and is being powered by the portable power supply 126, the controller 132 may be configured to accept a first input from a user via the user interface 130 that designates a first zone of the plurality of zones and causes each of two or more first wireless devices that are subsequently placed in an enrollment mode by the user to be enrolled in the first zone. The controller 132 may also be configured to accept a second input from the user via the user interface 130 that designates a second zone of the plurality of zones and causes each of two or more second wireless devices that are subsequently placed in an enrollment mode by the user to be enrolled in the second zone. In some cases, the controller 132 may be configured to provide via the user interface 130 a graphical display of all wireless devices within a particular zone, and as individual wireless devices are enrolled into the particular zone, icons representing those individual wireless devices appear on the graphical display as assigned to the particular zone.

Figure 6:
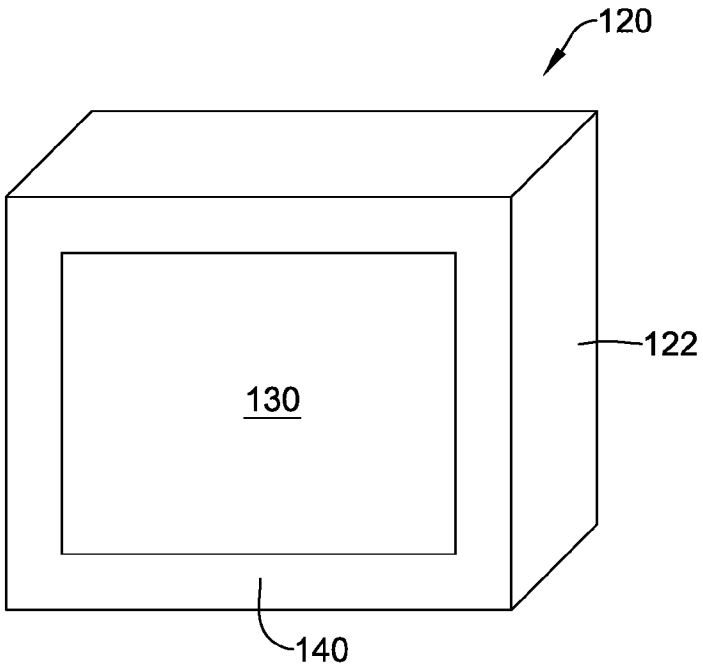
FIG. 6 is a front perspective view of an illustrative HVAC controller.
Figure 7:
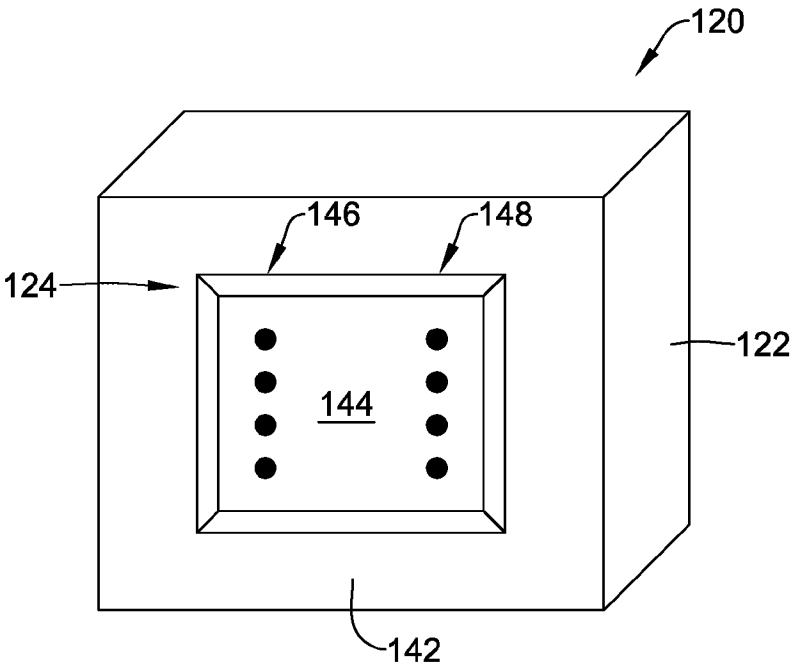
FIG. 7 is a back perspective view of the illustrative HVAC controller of FIG. 6.

FIGS. 6 through 10 provide an example of how the HVAC controller 120 may interact with a wall plate 150 (FIG. 8) and with the portable power supply 126. FIG. 6 is a front perspective view of the HVAC controller 120. The user interface 130 may be seen as being disposed on a front surface 140 of the housing 122. FIG. 7 is a rear perspective view of the HVAC controller 120, showing a back surface 142 of the housing 122. A recess 144 is formed within the back surface 142 of the housing 122. The plurality of terminal pins 124, shown as a first column 146 of terminal pins and a second column 148 of terminal pins, extend outwardly through the recess 144.

FIG. 8 is a schematic front perspective view of the wall plate 150. The illustrative wall plate 150 has a housing 152 that is configured to fit into the recess 144 that is formed in the back surface 142 of the housing 122 (of the HVAC controller 120). The wall plate 150 includes a first column 154 of terminals and a second column 156 of terminals. It will be appreciated that the first column 154 of terminals is configured to releasably accept the first column 146 of terminal pins and the second column 156 of terminals is configured to releasably accept the second column 148 of terminal pins when the HVAC controller 120 is releasably secured to the wall plate 150. The terminals within the first column 154 of terminals are operably coupled to a terminal block 158 that is shown schematically within the wall plate 150 and provide electrical connections to a first plurality of field wires 162. The terminals within the second column 156 of terminals are operably coupled to a terminal block 160 and provide electrical connections to a second plurality of field wires 164. It will be appreciated that the first plurality of field wires 162 and the second plurality of field wires 164 are merely illustrative, as some installations will have additional field wires and some installations will have fewer field wires.

Figure 9:
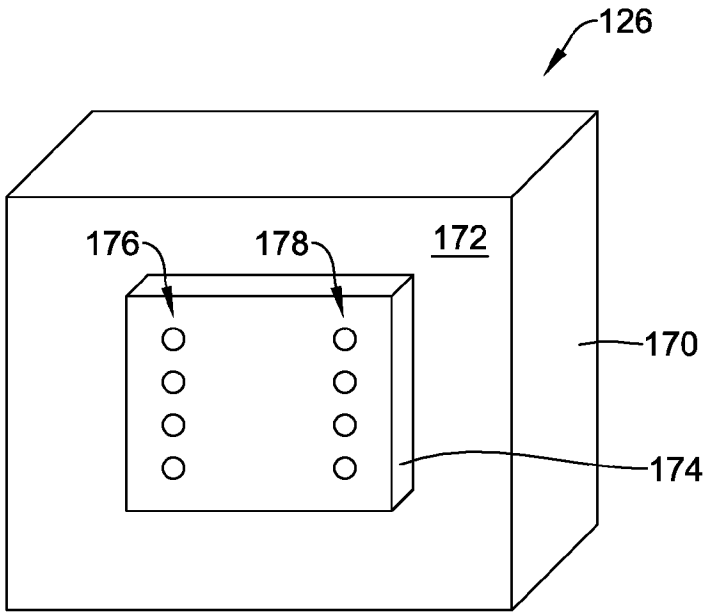
FIG. 9 is a front perspective view of an illustrative portable power supply that may be coupled to the illustrative HVAC controller of FIG. 6 when the illustrative HVAC controller of FIG. 6 is not coupled to the illustrative wall plate of FIG. 8.
Figure 10:
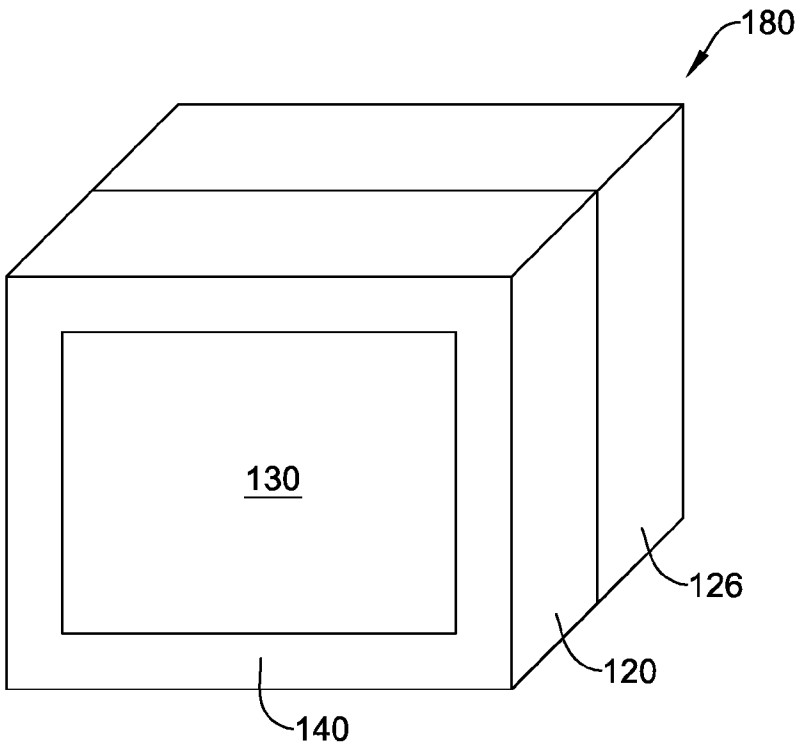
FIG. 10 is a front perspective view of the illustrative HVAC controller of FIG. 6 coupled to the illustrative portable power supply of FIG. 9.

FIG. 9 is a front perspective view of the portable power supply 126. The illustrative portable power supply 126 has a housing 170 defining a front surface 172. A raised portion 174 extends forward from the front surface 172. It will be appreciated that the raised portion 174 has an overall profile that matches or at least substantially matches that of the housing 152 of the wall plate 150. Accordingly, the raised portion 174 may be considered as being configured to extend into the recess 144 that is formed within the back surface 142 of the housing 122 (of the HVAC controller 120). The raised portion 174 includes a first column 176 of terminals that are configured to accommodate the first column 146 of terminal pins extending from the HVAC controller 120 as well as a second column 178 of terminals that are configured to accommodate the second column 148 of terminal pins extending from the HVAC controller 120. The portable power supply 126 may provide power to operate the HVAC controller 120 via the terminal pins 124 when the HVAC controller 120 is removed from the wall plate 150 and coupled with the portable power supply 126. The resulting assembly 180 may be seen in FIG. 10, for example.

Figure 11:
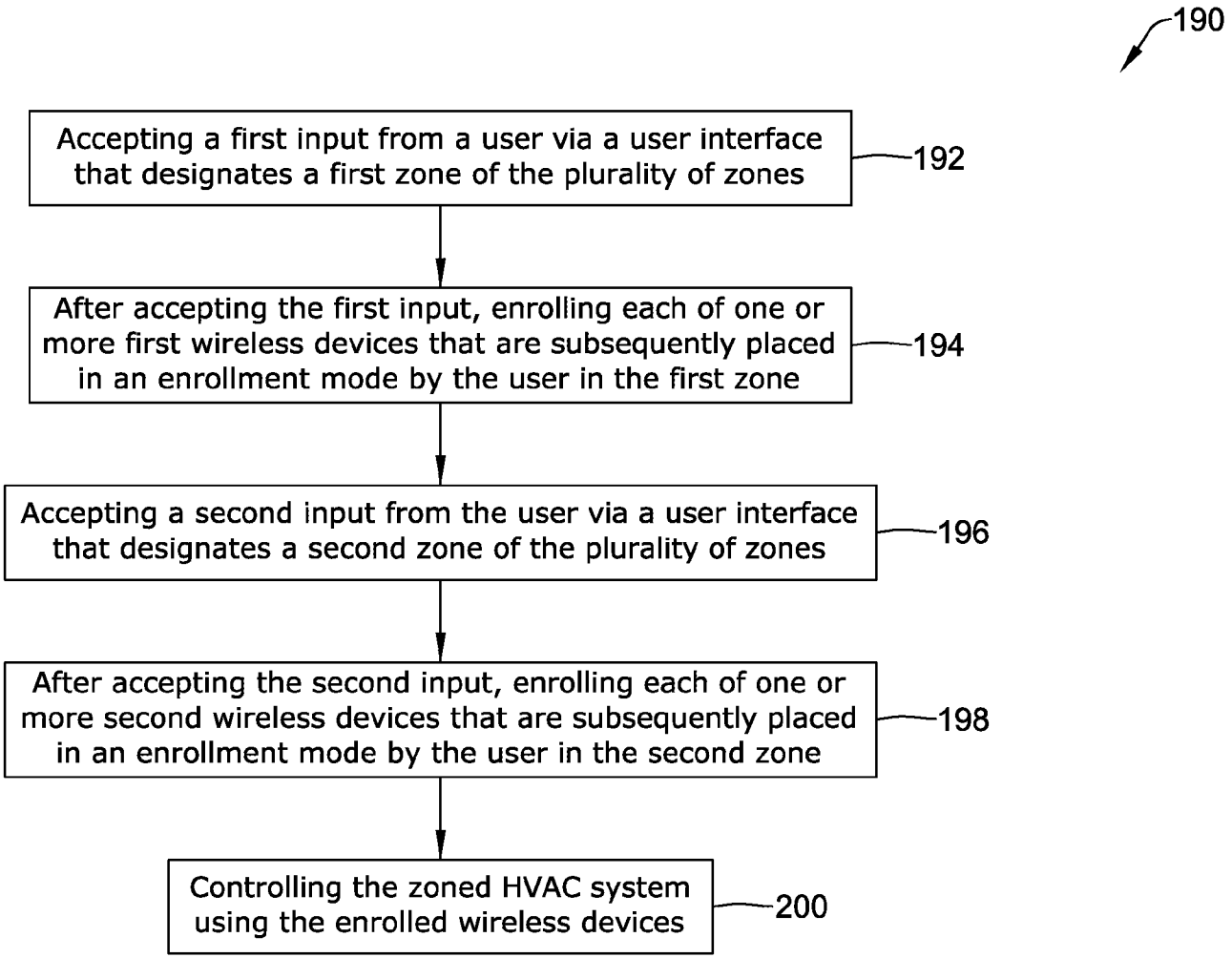
FIG. 11 is a flow diagram showing a method of enrolling a plurality of wireless devices into a zoned HVAC system such as the illustrative HVAC system of FIG. 3.

FIG. 11 is a flow diagram showing an illustrative method 190 of enrolling a plurality of wireless devices into a zoned HVAC system having a plurality of zones. It will be appreciated that this method may be carried out using the HVAC controller 18, 100, 120, regardless of whether the HVAC controller 18, 100, 120 is mounted to the wall, such as via the wall plate 150, or is portable as a result of being coupled to the portable power supply 126. A first input may be accepted from a user via a user interface that designates a first zone of the plurality of zones, as indicated at block 192. After accepting the first input, and as indicated at block 194, each of one or more first wireless devices that are subsequently placed in an enrollment mode by the user in the first zone may be enrolled. Subsequently, a second input may be accepted from the user via the user interface that designates a second zone of the plurality of zones, as indicated at block 196. After accepting the second input, and as indicated at block 198, each of one or more second wireless devices that are subsequently placed in an enrollment mode by the user in the second zone may be enrolled. As indicated at block 200, the zoned HVAC system may be controlled using the enrolled wireless devices.

Figure 12:
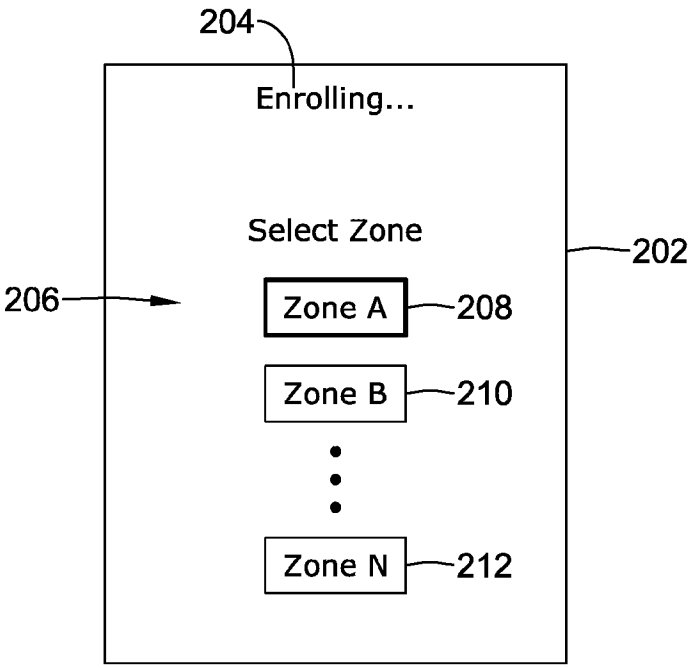
FIGS. 12 through 15 are illustrative screen shots that may be displayed by the illustrative HVAC controllers of FIGS. 4 and 5 when in the commissioning mode.
Figure 13:
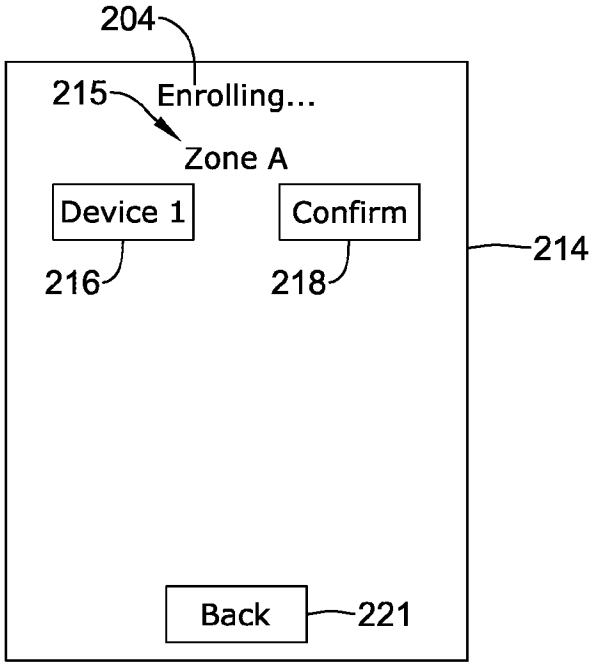

FIGS. 12 through 15 provide an illustrative but non-limiting examples of screens that may be displayed on the user interface 104, 130 when carrying out the method 190. FIG. 12 shows a screen 202 that includes an icon ENROLLING 204 that indicates that the HVAC controller 100, 120 is in its commissioning mode. The screen 202 also includes a ZONE SELECTION option 206. As illustrated, the ZONE selection option 206 includes a ZONE A button 208 that may for example correspond to the ZONE A labeled as 72 in FIG. 3, a ZONE B button 210 that may for example correspond to the ZONE B labeled as 74 in FIG. 3 and through to a ZONE N button 212 that may for example correspond to the ZONE N labeled as 76 in FIG. 3. It will be appreciated that this is merely illustrative, as there may be any number of distinct zones. In some cases, the user may define the number of zones for the building 70, and in some cases name the zones as desired. If there are too many zones to display simultaneously on the screen 202, the screen 202 may include a scrolling capability (not shown). As shown, the ZONE A button 208 has been selected, as indicated by the ZONE A button 208. This causes a screen 214, as shown in FIG. 13, to be displayed.

Figure 14:
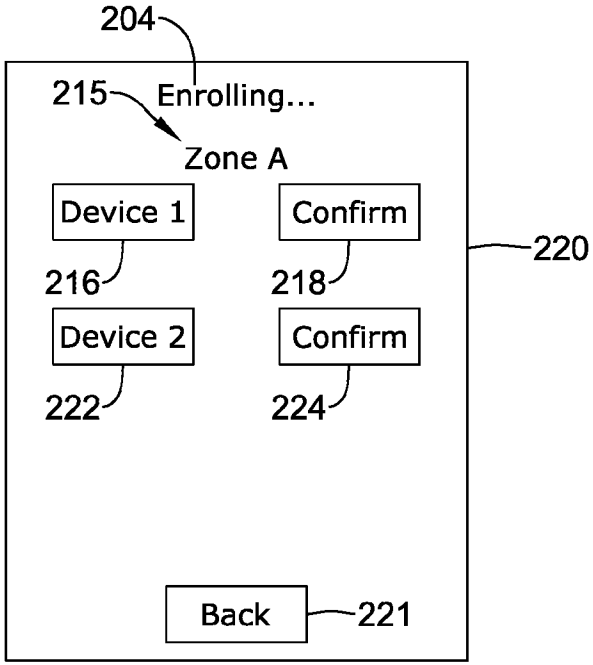

As can be seen, the screen 214 includes a ZONE A icon 215 to indicate that subsequent devices will be enrolled into Zone A. A Device 1 icon 216 and a confirm button 218 are displayed, as the result of Device 1 being placed in enrollment mode (e.g. push an enroll button on Device 1) and being provisionally enrolled in Zone A. When the user touches the confirm button 218, Device 1 is enrolled in Zone A. FIG. 14 shows a screen 220, after a Device 2 is placed in enrollment mode (e.g. push an enroll button on Device 2). Device 2 icon 222 and a corresponding confirm button 224 are displayed. When the user touches the confirm button 224, Device 2 is enrolled in Zone A. If there are additional devices to enroll in Zone A, additional devices will appear on the user interface 104, 130 as each device is enrolled.

Figure 15:
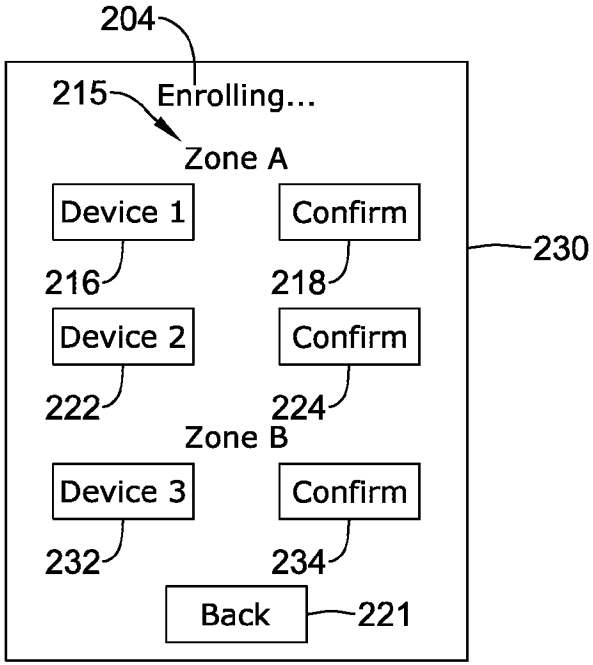

When the installer is done enrolling devices in Zone A, the installer can use the BACK button 221 to return to the screen 202 and select a subsequent zone. FIG. 15 shows a screen 230 that shows that the installer has moved on to Zone B. The screen 230 includes a Device 3 icon 232 and an accompanying Confirm button 234 under Zone B. As additional devices are enrolled, it will be appreciated that the screen 230 may include a scrolling feature (not illustrated).

Those skilled in the art will recognize that the present disclosure may be manifested in a variety of forms other than the specific embodiments described and contemplated herein. Accordingly, departure in form and detail may be made without departing from the scope and spirit of the present disclosure as described in the appended claims.

What is claimed is:

1. A building controller configured to monitor and control one or more operations of a building, the building controller comprising:

a user interface;

a controller, of the building controller, operably coupled to the user interface, the controller configured to:

operate in an operational mode in which the controller provides operational instructions to a zoned system;

operate in a commissioning mode in which the controller is configured to enroll a plurality of wireless devices into a particular zone of a plurality of zones;

while in the commissioning mode, accept a first input from a user via the user interface that designates a first zone of the plurality of zones and causes each of two or more first wireless devices that are subsequently placed in an enrollment mode by the user to be enrolled in the first zone and accept a second input from the user via the user interface that designates a second zone of the plurality of zones and causes each of two or more second wireless devices that are subsequently placed in an enrollment mode by the user to be enrolled in the second zone;

while in the commissioning mode with the first zone designated, identify to the user a location of a first one of the two or more first wireless devices that are enrolled in the first zone by sending a command to the first one of the two or more first wireless devices that causes the first one of the two or more first wireless devices to output an audible and/or visual indicator configured to be perceived by the user; and control the enrolled plurality of wireless devices.

2. The building controller of claim 1, wherein the one or more wireless devices comprise:

an equipment interface module (EIM) and one or more Heating, Ventilation and Air Conditioning (HVAC) components.

3. The building controller of claim 2, wherein the one or more HVAC components comprise a furnace, a heat pump, an electric heat pump, a geothermal heat pump, an electric heating unit, an air conditioning unit, a humidifier, a dehumidifier, an air exchanger, an air cleaner, a damper, and a valve.

4. The building controller of claim 1, wherein the one or more wireless devices comprise a flow sensor, an air filter monitor, a temperature sensor, a humidity sensor, a position sensor, a pressure sensor, a differential pressure sensor, and an air quality sensor.

5. The building controller of claim 1, wherein the one or more wireless devices comprise components for a security system, a fire suppression system, and an energy management system.

6. The building controller of claim 1, wherein in the commissioning mode, with the first zone designated, the controller is further configured to identify to the user a location of a second one of the two or more first wireless devices that are enrolled in the first zone by sending a command to the second one of the two or more first wireless devices that causes the second one of the two or more first wireless devices to output an audible and/or visual indicator configured to be perceived by the user.

7. The building controller of claim 1, wherein in the commissioning mode, with the second zone designated, the controller is further configured to identify to the user a location of a first one of the two or more second wireless devices that are enrolled in the second zone by sending a command to the first one of the two or more second wireless devices that causes the first one of the two or more second wireless devices to output an audible and/or visual indicator configured to be perceived by the user.

8. The building controller of claim 1, wherein in the commissioning mode, with the first zone designated, the controller is further configured to change a first one of the two or more first wireless devices that are enrolled in the first zone from a first state to a second state by sending a command to the first one of the two or more first wireless devices that causes the first one of the two or more first wireless devices to change from the first state to the second state.

9. The building controller of claim 1, wherein the controller is configured to receive one or more status indications from each of the enrolled wireless devices, and to display one or more corresponding status indicators on a display of the user interface.

10. The building controller of claim 9, wherein the one or more status indications comprise one or more of a sensed temperature, an indication of a damper position, a signal strength, an online connection status, or a battery charge status.

11. The building controller of claim 1, wherein the controller is configured to display on the user interface a list of enrolled wireless devices, and the controller is further configured to accept via the user interface instructions to move one of the enrolled wireless devices from one zone to another zone.

12. The building controller of claim 1, wherein at least some of the plurality of wireless devices comprise wireless remote temperature sensors configured to be distributed about the building, and when in the operational mode, the controller is configured to operate the zoned system in accordance with temperature signals received from the wireless remote temperature sensors.

13. The building controller of claim 1, wherein the user interface is part of a smartphone or tablet that is in communication with the building controller.

14. A method of enrolling a plurality of wireless devices into a zoned system for a building comprising a plurality of zones, the method comprising:

accepting a first input from a user via a user interface that designates a first zone of the plurality of zones;

after accepting the first input, placing each of one or more first wireless devices in an enrollment mode by the user and enrolling each of one or more first wireless devices into the first zone;

accepting a second input from the user via the user interface that designates a second zone of the plurality of zones;

after accepting the second input, placing each of one or more second wireless devices in an enrollment mode by the user and enrolling each of one or more first wireless devices into the second zone; and controlling the enrolled wireless devices, wherein at least some of the plurality of wireless devices comprises remote dampers, and when in the operational mode, the controller is configured to provide operational instructions to the remote dampers in order to operate the zoned HVAC system in accordance with temperature signals from the wireless remote temperature sensors.

15. The method of claim 14, wherein the plurality of wireless devices comprises: an equipment interface module (EIM), one or more Heating, Ventilation and Air Conditioning (HVAC) components, and components for a security system, a fire suppression system, and an energy management system.

16. The method of claim 14, further comprising, after accepting the first input and enrolling the one or more first wireless devices, sending a command to a first one of the one of more first wireless devices that causes the first one of the one or more first wireless devices to output an audible and/or visual indicator configured to be perceived by the user.

17. The method of claim 14, further comprising, after accepting the second input and enrolling the one or more second wireless devices, sending a command to a first one of the one or more second wireless devices that causes the first one of the one or more second wireless devices to output an audible and/or visual indicator configured to be perceived by the user.

18. A building controller configured to monitor and control one or more operations of a building, the building comprising a zoned system that includes a plurality of wireless devices divided into a plurality of zones within the building, the controller comprising:

a user interface;

a controller operably coupled to the user interface, the controller configured to:

operate in an operational mode in which the controller provides operational instructions to the zoned system;

operate in a commissioning mode in which the controller is configured to enroll the plurality of wireless devices into a particular zone of the plurality of zones;

while in the commissioning mode, accept a first input from a user via the user interface that designates a first zone of the plurality of zones and causes each of two or more first wireless devices that are subsequently placed in an enrollment mode by the user to be enrolled in the first zone and accept a second input from the user via the user interface that designates a second zone of the plurality of zones and causes each of two or more second wireless devices that are subsequently placed in an enrollment mode by the user to be enrolled in the second zone;

while in the commissioning mode, with the first zone designated, the controller is further configured to change a first one of the two or more first wireless devices that are enrolled in the first zone from a first state to a second state by sending a command to the first one of the two or more first wireless devices that causes the first one of the two or more first wireless devices to change from the first state to the second state; and control the enrolled wireless devices.

19. The building controller of claim 18, further comprising a power input for receiving power from a power source to power the HVAC controller, wherein the power source comprises a portable power pack that is removably attachable to the HVAC controller to deliver power to the power input of the HVAC controller.

* * * * *